US005624740A

United States Patent [19]

Nakata

[11] Patent Number: 5,624,740

[45] Date of Patent: Apr. 29, 1997

[54] DOORMATS MANUFACTURING APPARATUS

[75] Inventor: Akira Nakata, Komaki, Japan

[73] Assignee: Yugengaisya Towa, Aichi-ken, Japan

[21] Appl. No.: 616,236

[22] Filed: Mar. 13, 1996

Related U.S. Application Data

[60] Continuation of Ser. No. 318,939, Oct. 6, 1994, abandoned, which is a division of Ser. No. 263,671, Jun. 22, 1994, abandoned.

[30] Foreign Application Priority Data

Jul. 27, 1993 [JP] Japan ..... 5-205743

[51] Int. Cl.[6] ..... B32B 3/00

[52] U.S. Cl. ..... 428/204; 425/199; 425/381.2; 425/382 R; 425/382.2; 156/441; 156/500

[58] Field of Search ..... 425/198, 176, 425/204, 463, 464, 382 R, 382.2; 156/433, 441, 500

[56] References Cited

U.S. PATENT DOCUMENTS

| | | | |
|---|---|---|---|
| Re. 31,599 | 6/1984 | Rasen et al. . | |
| 3,666,608 | 5/1972 | Mattes . | |
| 3,687,796 | 8/1972 | Stumpf | 161/67 |
| 3,709,768 | 1/1973 | Stumpf . | |
| 3,762,850 | 10/1973 | Werner et al. | 425/198 |
| 3,837,988 | 9/1974 | Hennen | 161/67 |
| 3,852,152 | 12/1974 | Werner | 161/168 |
| 3,936,337 | 2/1976 | Stapp | 156/167 |
| 4,342,802 | 8/1982 | Pickens, Jr. et al. | 428/92 |
| 4,351,683 | 9/1982 | Kusilek | 156/167 |
| 4,645,699 | 2/1987 | Neveu . | |
| 4,849,271 | 7/1989 | Weihrauch . | |
| 4,859,516 | 8/1989 | Yamanaka | 428/92 |
| 5,294,258 | 3/1994 | Jarrell et al. | 118/410 |

*Primary Examiner*—Merrick Dixon
*Attorney, Agent, or Firm*—Lowe, Price, LeBlanc & Becker

[57] ABSTRACT

A doormat manufacturing apparatus contains a spinning pack having a plane rectangular shape for spinning a large number of monofilaments, a plurality of extruders disposed at symmetrical positions in the longitudinal direction of the spinning pack for supplying a plurality of molten synthetic resins to the spinning pack, and a collecting mechanism for collecting monofilaments discharged from the spinning pack. The spinning pack contains a resin flowpath changeover unit arranged over a multihole nozzle plate, and the resin flowpath changeover unit is connected to each extruder by a respective communicating pipeline. The communicating pipelines are arranged at symmetrical positions in the longitudinal direction of the spinning pack. The resin flowpath changeover unit has a plurality of longitudinally extending main flowpaths, each of which communicates with a respective communicating pipeline via a respective zone flowpath and with a respective branch flowpath extending crosswise from the main flowpath. The pluralities of branch flowpaths substantially cover the surface of the resin flowpath changeover unit, and the multihole nozzle plate has a nozzle hole in communication with each branch flowpath.

4 Claims, 8 Drawing Sheets

DOORMATS MANUFACTURING APPARATUS

This application is a continuation of application Ser. No. 08/318,939 filed Oct. 6, 1994, now abandoned which is a divisional of Ser. No. 08/263,671 filed on Jun. 22, 1994, now abandoned.

BACKGROUND OF THE INVENTION

This invention relates to colored doormats, a method of manufacturing doormats and a doormat manufacturing device in which the doormats, usually placed before a door or other entrance of a building or a house, for scraping mud or dirt from the shoes, and particularly, such doormats are formed of numerous synthetic resin monofilaments in random loops form, and such numerous synthetic resin monofilaments are respectively colored, and these colored synthetic resin monofilaments are combined with colored monofilaments of two colors or more than two colors to produce mottled doormats or a striped doormats whereby attractively colored doormats having decorative effect or attraction of beauty are available.

Heretofore, many a mat which is produced by accumulating synthetic resin monofilaments in random form have been known. However, the conventional doormat of this kind is not colored or decorated with a pattern, and the entire mat is formed in monochrome, and as a result, such mat is an extremely short of attractive power from the standpoint of shadings of color, multi-coloration.

SUMMARY OF THE INVENTION

An object of this invention is to provide doormats which are formed by accumulating numerous synthetic resin monofilaments in random loops and combining the colored synthetic resin monofilaments with colored synthetic resin monofilaments of two colors or more than two colors whereby mottled or striped doormats are available.

Another object of this invention is to provide a doormat manufacturing method and a doormat manufacturing device, in which in order to produce mottled or striped doormats, numerous synthetic resin monofilament are accumulated in random loops by combining the colored synthetic resin monofilaments. A spinning pack of plane rectangular shape for spinning numerous synthetic rein monofilaments comprises a resin flowpath changeover unit and a multi-hole nozzle plate, and the resin flow path changeover unit is provided with communicating pipelines 5A, 5B, at symmetric positions in longitudinal direction, and they are connected to extruders 6A, 6B, and a plurality of zone flowpaths 9A, 9B, are independently formed on an almost entire surface of the resin flow path changeover unit to be communicated with each communicating pipe line 5A, 5B to feed the different colored molten resin from each extruder 6A, 6B, and a collecting belt is disposed in the lower part of the spinning pack to accumulate the colored monofilaments spun from the spinning pack in random form, which belt is supported on a pair of belt wheels rotating in the same direction. Particularly, a pattern to be formed by the colored monofilaments is freely changed over to an expression of mottles or stripes by the direction of forming numerous branch flowpaths to be provided on each zone flowpath 9A, 9B. Each of the branch flowpaths is formed in a row in an oblique or parallel form in a crosswise direction of the resin flowpath changeover unit.

A still further object of this invention is to provided a doormat, a doormat manufacturing method and a doormat manufacturing device in which in lieu of the collecting belt disposed in the lower part of the spinning pack, a cooling water tank is provided and a forming roll is installed in the cooling water tank, and the colored monofilaments being spun from the spinning pack are received by the surface of the forming roll to accumulate them in random pools and the resulting accumulation is transformed into three layers, a bottom layer, a surface layer, and a middle layer sandwiched between the surface layer and the bottom layer, and the mottled pattern or the striped pattern are produced equally on the surface layer, middle layer and bottom layer.

DETAILED DESCRIPTION OF THE INVENTION

Figure 1:
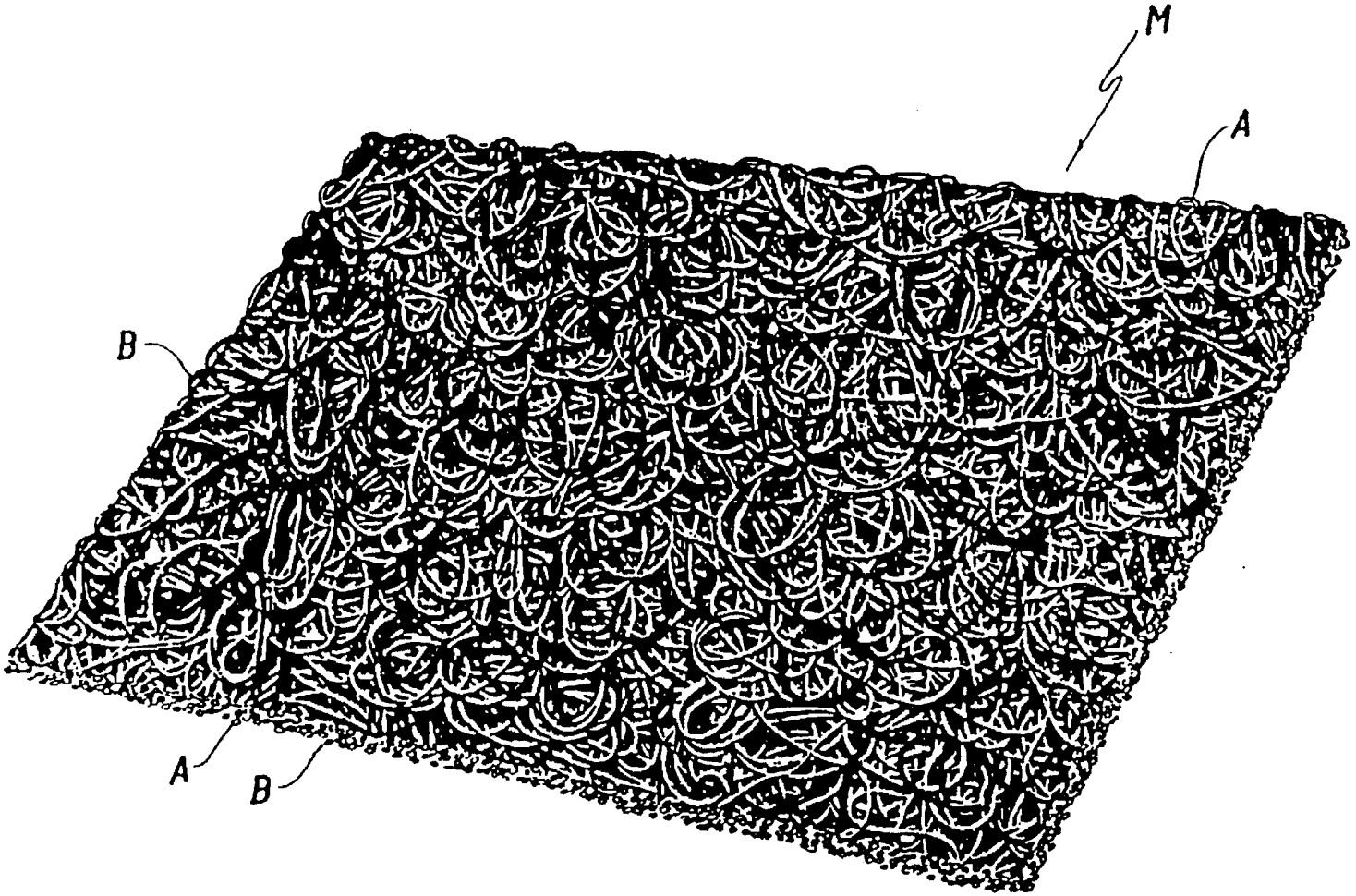
FIG. 1 is a perspective view of a multicolor doormat having a mottled pattern.
Figure 2:
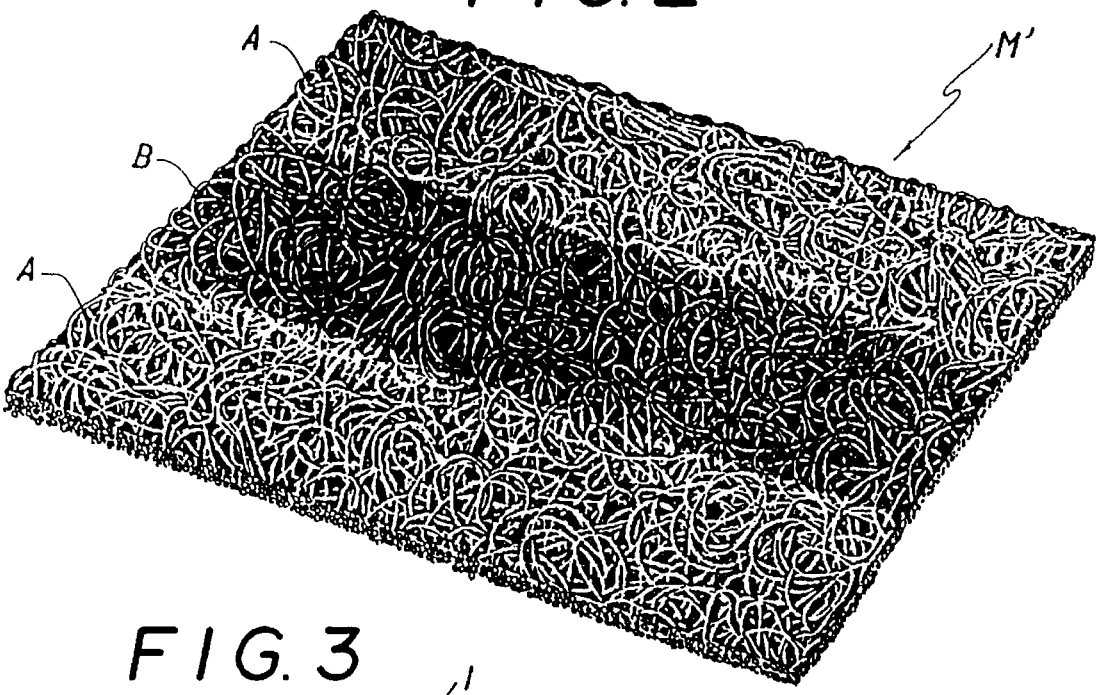
FIG. 2 is a perspective view of a multicolor doormat having a striped pattern.

FIG. 1 shows a mottled multicolor doormat M produced by accumulating two colored monofilaments in the A color and the B color in mutually random loops and the adjacent monofilaments being different colors, and FIG. 2 shows a striped multicolor doormat M' produced by disposing two colored monofilaments in the A color and the B color alternately in a predetermined width and accumulating the colored monofilaments in a random loop form.

Figure 3:
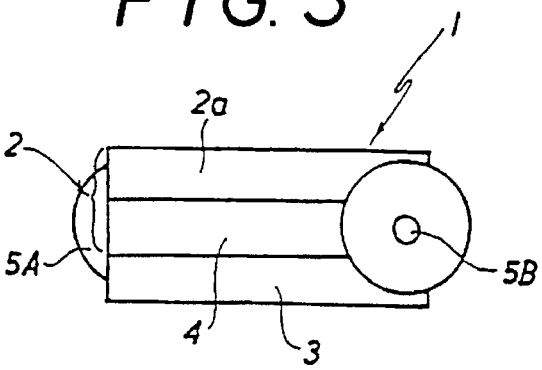
FIG. 3 is a side of a spinning pack.
Figure 7:
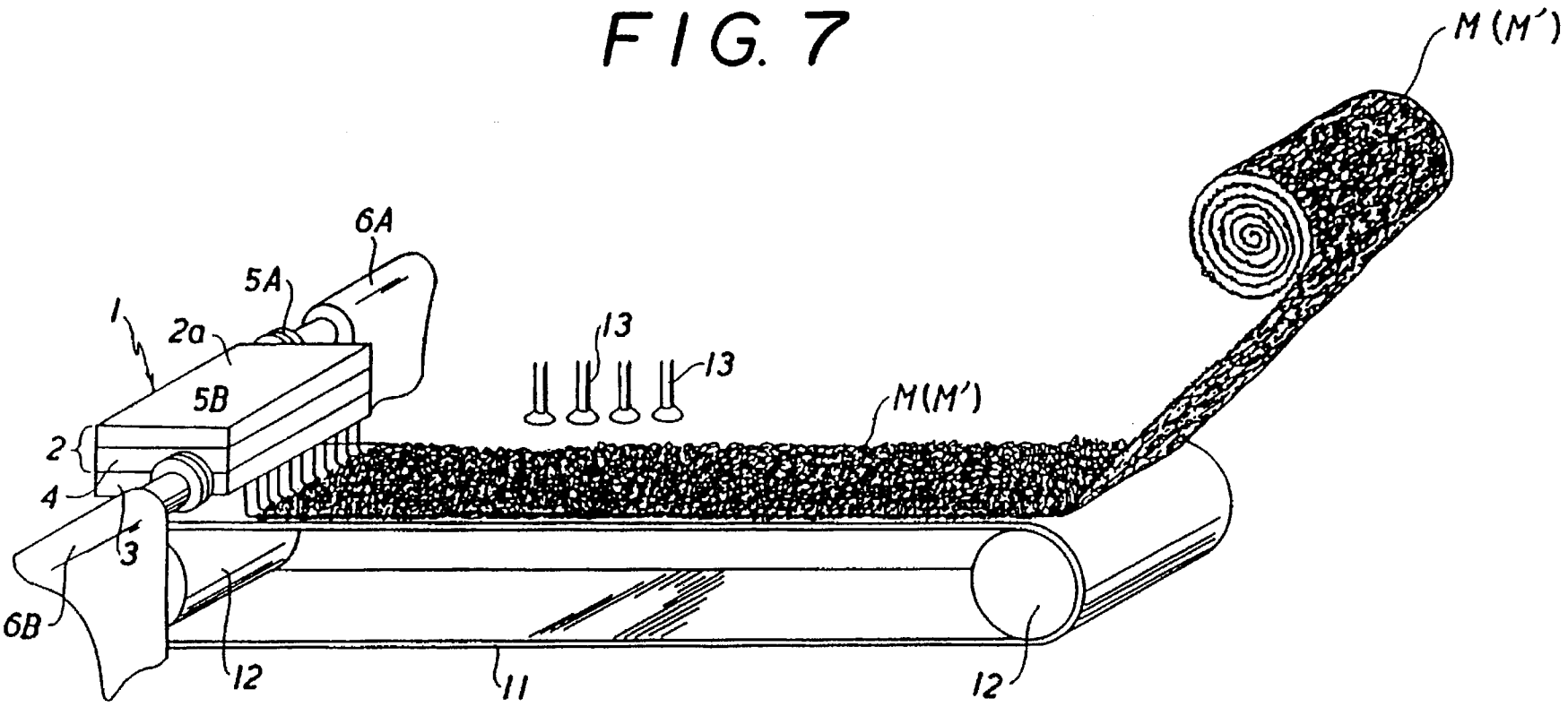
FIG. 7 is a perspective view of a construction of a manufacturing device for working an Example 1.

FIG. 3 shows a spinning pack of plane rectangular shape that spins out the group of monofilaments to produce continuously the doormat having the color pattern in high productivity, and the spinning pack 1 comprises a resin flowpath changeover unit 2 and a multi-hole nozzle plate 3, but the resin flowpath changeover unit 2 is divided into a cover **2*a* and a flowpath changeover frame plate 4 for the convenience of fabrication. The spinning pack is constructed by superposing the cover plate 2*a*, flowpath changeover frame plate 4 and multi-hole nozzle plate 3 in this order from top to bottom. Communicating pipe lines 5A and 5B projecting at symmetrical positions in the longitudinal direction of the resin flowpath changeover frame plate 4 are connected to extruders 6A and 6B to be used as shown in FIG. 7. The A colored molten resin which is soft vinyl chloride resin, ethylene acetic acid vinyl polymer or the like is extruded and supplied from the extruder 6A, and the B colored molten resin which is soft vinyl chloride resin, ethylene acetic acid vinyl polymer or the like is extruded and supplied from the extruder 6**B.

Figure 4:
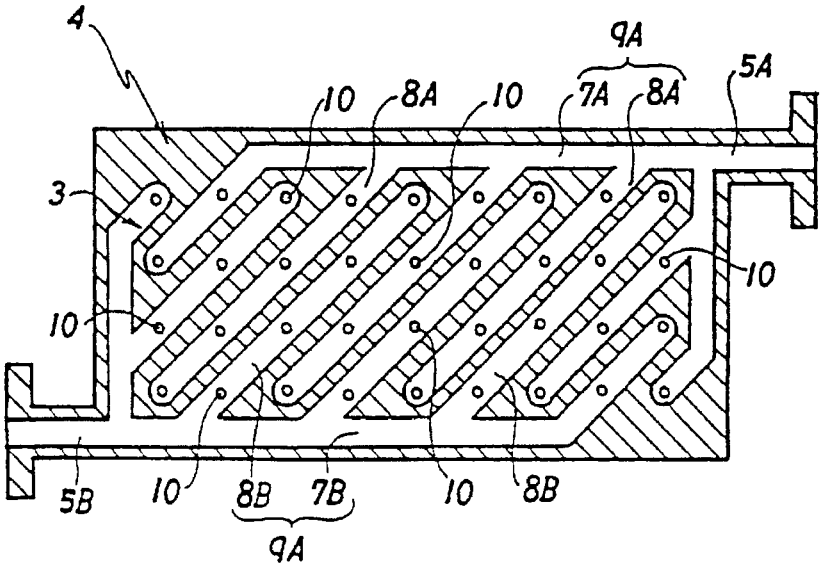
FIG. 4 is a plan of a resin flowpath changeover unit and a multi-hole nozzle plate suitable for manufacture of multicolor doormat as shown in FIG. 1.

FIG. 4 is a plan of the multi-hole nozzle plate 3 provided on the resin flowpath changeover frame plate 4 of the spinning pack 1, and this resin flowpath changeover frame plate 4 is provided with main flowpaths 7A and 7B communicating with the communicating pipe lines 5A and 5B along both sides in the longitudinal direction, and a plurality (5 stripes each in the illustration) of branch flowpaths 8A and 8B in oblique form are provided on these main flowpaths 7A and 7B alternately, and a zone flowpath 9A is formed by the group of the main flowpath 7A and the branch flowpath 8A, and also, a zone flowpath 9B is formed by the group of the main flowpath 7B and the branch flowpath 8B which is in symmetric with the zone flowpath 9A. Furthermore, a plurality of nozzle holes 10 are bored on the multi-hole nozzle plate 3 which are exposed to each of the branch flowpaths 8A and 8B. The A colored resin is supplied to the zone flowpath 9A through the communicating pipe line 5A connected to the extruder 6A and the A colored monofilament are spun from each nozzle hole 10 which is disposed to the zone flowpath 9A, and in the same manner the B colored monofilaments are spun from each nozzle hole 10 disposed to the zone flowpath 9B. When these A and B colored monofilaments are accumulated on the collecting belt 11 to be described hereinafter while drawing the random loop form, the adjacent monofilaments form the two color mottled pattern by the arrangement of the A and B colors.

Figure 5:
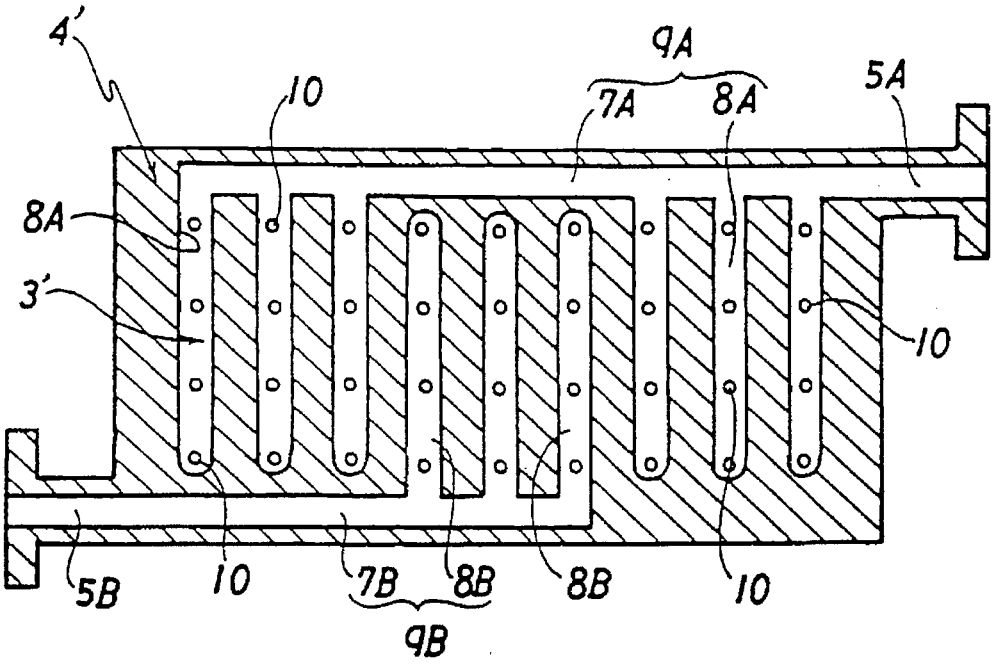
FIG. 5 is a plan of a resin flowpath changeover unit and a multi-hole nozzle plate suitable for manufacture of multicolor doormat as shown in FIG. 2.

FIG. 5 shows a plan of a resin flowpath changeover frame plate 4' and a multi-hole nozzle plate 3' of the spinning pack 1 to produce a colored striped doormat of different color by disposing the monofilaments of the same color in a width as shown in FIG. 2, and the resin flowpath changeover frame plate 4' is provided with the main flowpaths 7A and 7B communicating with the communicating pipe lines 5A and 5B along both the sides in the longitudinal direction, but the one main flowpath 7A is provided on the entire length in the longitudinal direction of the resin flowpath changeover frame plate 4', and the other main flowpath 7B is provided on the length of ⅔ in the longitudinal direction of the resin flowpath changeover frame plate 4'. The zone flowpath 9B is formed by arranging three stripes of the branch flowpaths 8B rectangularly at a position of the central portion of the resin flowpath changeover frame plate 4' on the other main flowpath 7B, and the zone flowpath 9A is formed by arranging the three stripes of the branch flowpaths 8A on the one main flowpath 7A so that they are positioned at both sides of the branch flowpaths 8B. Also, a plurality of nozzle holes 10 are bored on the multi-hole nozzle plate 3' similar to FIG. 4 which are disposed to each of the branch flowpaths 8A and 8B. The colored monofilaments are spun from each nozzle hole 10 by supplying the A colored resin from the zone flowpath 9A and the B colored resin from the zone flowpath 9B like the manner as explained in FIG. 4 whereby in case these monofilaments are accumulated on the collecting belt 11 to be described hereinafter while drawing the random loop form, the striped pattern is formed which is of the same color at a unit of a width of each three-stripe of the branch flowpaths 7A or the branch flowpaths 7B.

Thus, the mottled multicolor doormat or the striped multicolor doormat can be freely changed over to manufacture by changing the resin flowpath changeover frame plate 4 or 4'.

Figure 6:
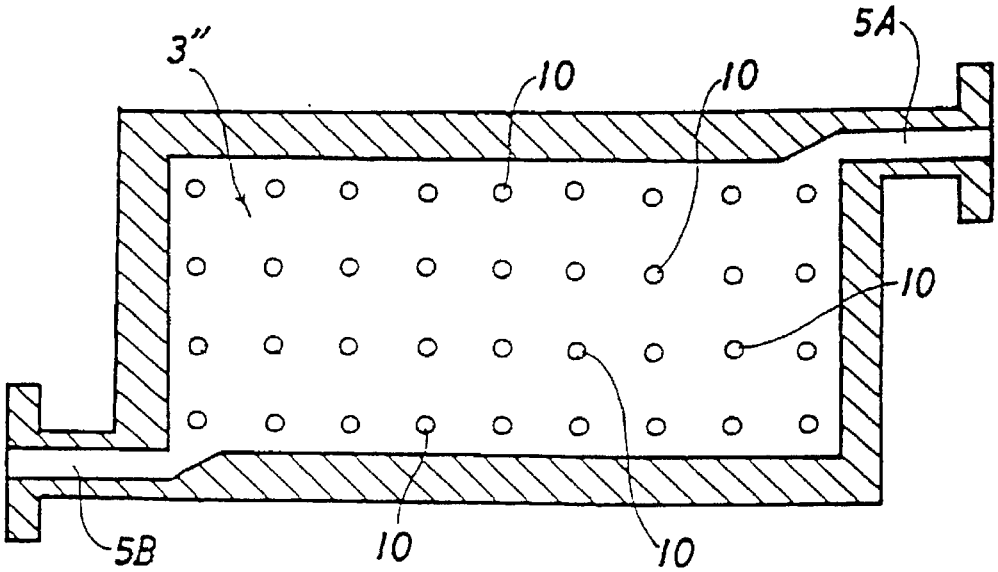
FIG. 6 is a plan of a multi-nozzle plate as shown in an embodiment.

FIG. 6 shows a plurality of nozzle holes 10 on a flat surface of a multi-hole nozzle plate 3" without providing the branch flowpaths 8A and 8B as shown in FIG. 4 and FIG. 5. In this case, the A colored resin and the B colored resin flowing from the communicating pipe lines 5A and 5B connected to the extruders 6A and 6B are mixed in the nozzle plate 3" to accumulate on the collecting belt 11 to be described hereinafter while drawing the random loop form by the nozzle holes 10, whereby the mottled pattern to be changed further from that of the doormat M as shown in FIG. 4 is available.

The following working examples illustrate the present invention more specifically.

EXAMPLE 1

FIG. 7 shows a perspective view of a construction of a device for manufacturing continuously the multicolor doormats M and M' in high productivity. In the drawing, reference numeral 11 shows a collecting belt on which belt wheels 12 are in rotational contact in an identical direction, and the spinning pack 1 is disposed in opposition in the upper part closer to the lefthand of the collecting belt 11. Furthermore, a plurality of cooling devices 13 are disposed in the upper part of the central portion of the collecting belt 11. A required distance is provided between the multi-hole nozzle plate 3 and the collecting belt 11, and the transfer speed of the collecting belt 11 is set slower than the spinning speed of the group of monofilaments. The group of monofilaments which are spun from each nozzle hole 10 is accumulated on the collecting belt 11 while drawing the random loop form, and at the same time, the contacting monofilaments themselves are mutually and partially fused, and the doormat M of the uniform thickness is continuously formed. The resulting doormat M transfers on the collecting belt 11, and is cooled by the cooling device 13, and is peeled off from the collecting belt 11 in the upper part of the belt wheel 12, and is coiled.

EXAMPLE 2

Figure 8:
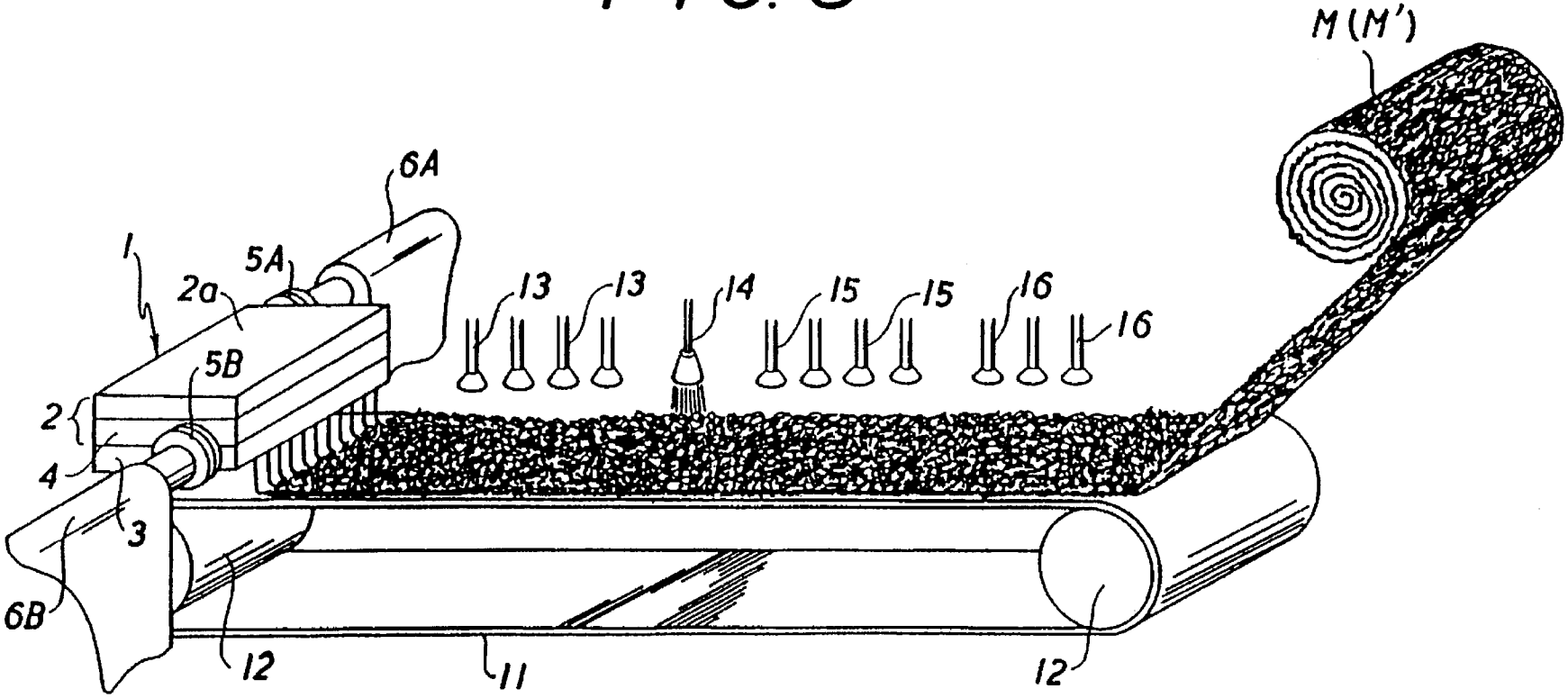
FIG. 8 is a perspective view of a construction of a manufacturing device for working an Example 2.

FIG. 8 shows a perspective view of a construction of a device for intensification of joining of the monofilaments of the doormats M and M', and in addition to the construction of the device shown in FIG. 7, an adhesive applying device 14, heating-drying device 15 and cooling device 16 are sequentially disposed from left to right according to the advancing direction of the collecting belt 11 in the upper part of the collecting belt 11. This embodiment shows that the doormats M and M' manufactured similar to the Example 1 are cooled by the cooling device 13 and the doormat M shifting on the collecting belt 11 applied with the adhesive by the adhesive applying device 14, and is dried by the heating-drying device 15, and then, is cooled by the cooling device 16 whereby the doormat is manufactured.

EXAMPLE 3

Figure 9:
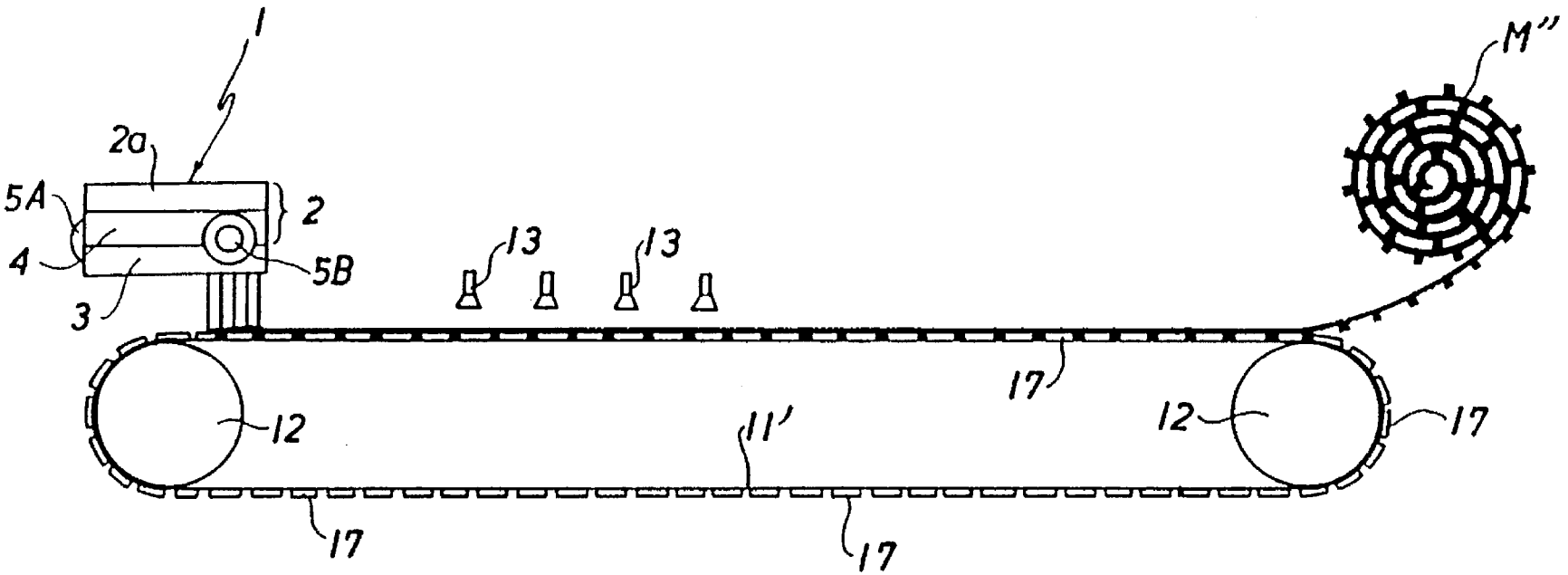
FIG. 9 is a schematic view of a construction of a manufacturing device for working an Example 3.
Figure 10:
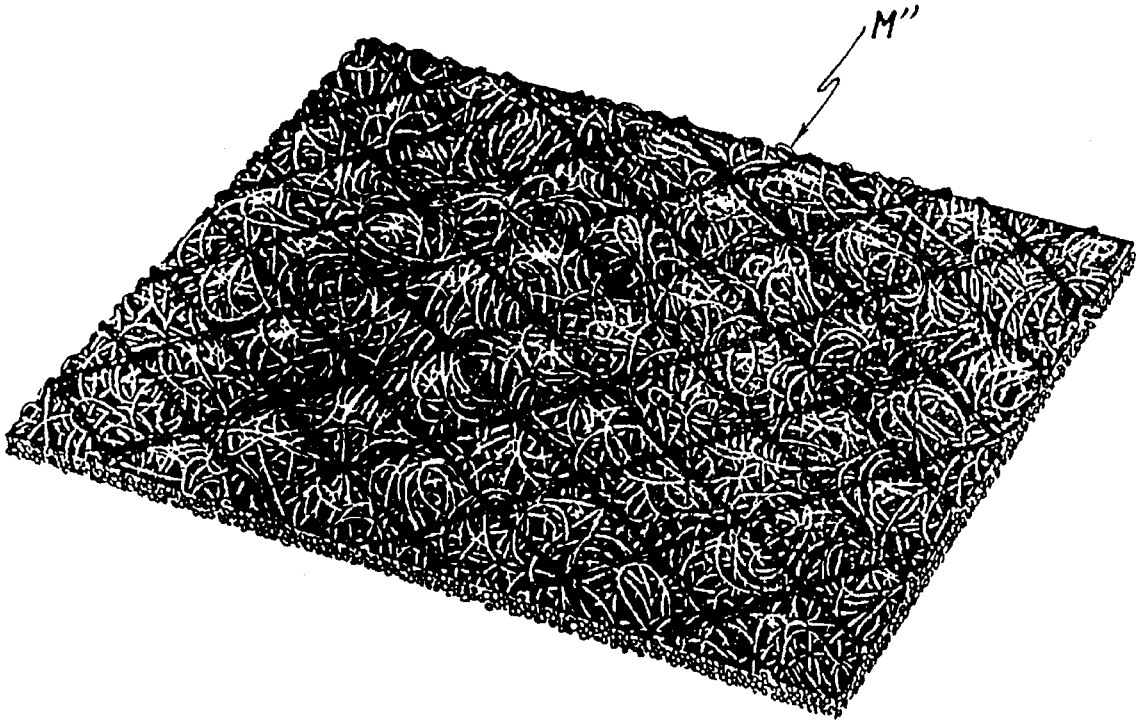
FIG. 10 is a perspective view seen from reverse of a multicolor doormat manufactured in the Example 3.

FIG. 9 shows that convex portions 17 of a diamond pattern at equal interval are projectingly formed on the surface of the collecting belt 11'. When the doormats M, M' are manufactured according to the Example 1 using the collecting belt 11' provided with the convex portions 17 of the diamond pattern as described in the foregoing, the group of monofilaments are accumulated along the diamond pattern of the convex portions 17, and the bulged portion of the diamond pattern are formed on the reverse of the doormats M, M', and cavity portions of the diamond pattern are formed by the convex portions 17 of each bulged portion, whereby the doormats M, M' having excellent anti-slippage effect are continuously formed whose entire surfaces are of concave and convex surfaces as a whole as shown in FIG.

10. The doormat M" formed with the concave and convex surfaces may be utilized for the mottled multicolor doormat or the striped multicolor doormat as shown in FIG. 1 and FIG. 2.

By the way, the anti-slippage effect can demonstrate on account of the formation of the concave and convex surfaces having a variety of shapes by changing the convex portions 17 of the diamond pattern which projected on the collecting belt 11'.

EXAMPLE 4

Figure 11:
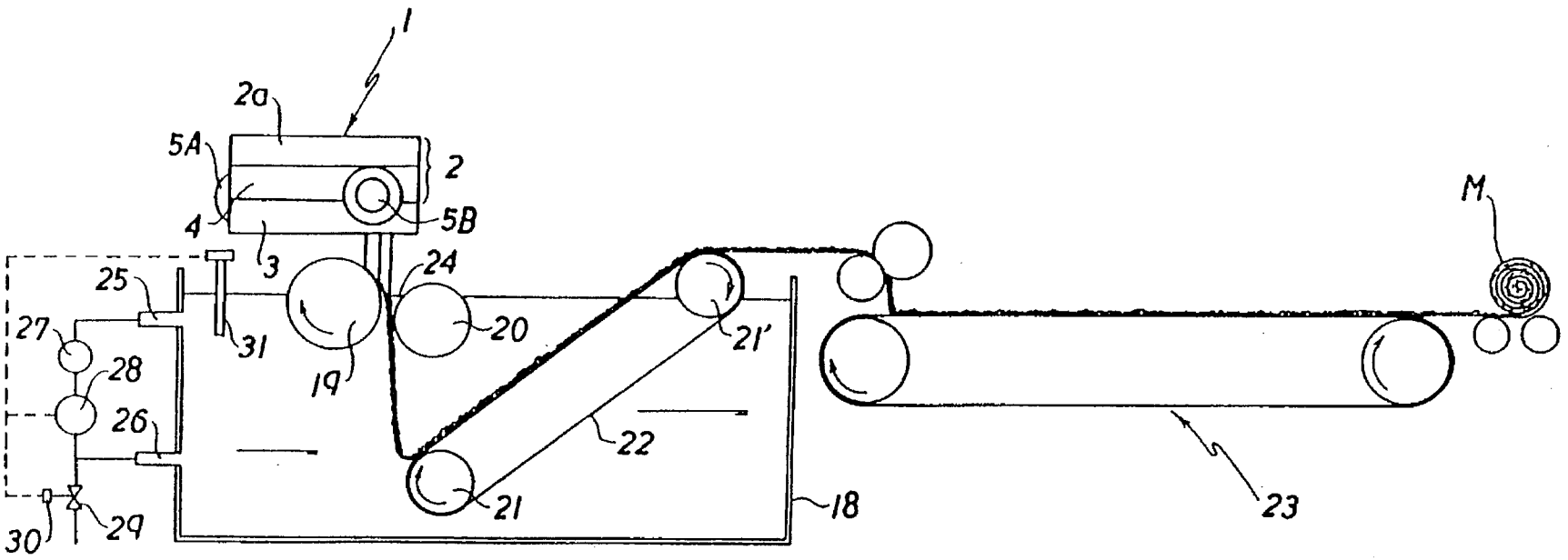
FIG. 11 is a schematic view of a construction showing another embodiment of a manufacturing device for working an Example 4.

FIG. 11 shows a schematic view of a construction of the device for manufacturing according to another manufacturing method.

In the construction of the this device, a cooling water tank 18 is disposed in the lower part of the spinning pack 1, and a forming roll 19 is disposed at a position immediately below the row of the colored monofilaments spun from the spinning pack 1 in the cooling water tank 18. A receiving roll 20 is disposed to be adjacent to the forming roll 19 and furthermore, a carrying belt 22 being supported by belt wheels 21, 21' is provided in the lower part of the receiving roll 20. Reference numeral 23 denotes a carrying conveyer for carrying the doormat which is disposed outside of the cooling water tank 18.

The cooling water whose temperature is kept at a fixed value (50°–60° C.) is stored inside of the cooling water tank 18. This cooling water is set at a temperature that does not drastically cool a plurality of the monofilaments spun from the spinning pack 1 and gradually cools them so that the group of loops of a uniform size may be formed.

The water temperature of the cooling water tank 18 is adjusted as follows. An outflow pipe 25 communicating with the inside is provided on the upper part of the side wall of the cooling water tank 18, and an inflow pipe 26 is similarly provided in the lower part thereof, and the outflow pipe 25 and the inflow pipe 26 are connected by means of a circulating pump 27 and a hot water heater 28, and a water feed pipe 30 provided with a cooling water supply valve 29 is connected to the rear of the hot water heater 28. Also, a water temperature gauge 31 is disposed at the other side of the cooling water tank 18 and its detecting unit is submerged in the water.

The water temperature in the cooling water tank 18 is adjusted to keep a constant temperature by signals emitted from the water temperature gauge 31 so that the water in the tank is pumped into the hot water heater 28 from the inflow pipe 26 and is heated, and the heated hot water is returned into the tank from the outflow pipe 25 or the cooling water valve 29 is released to flow the cooling water sent from the water feed pipe 30 into the tank from the outflow pipe 25. By the way, the water level 24 of the cooling water is set to be a predetermined level in the lower part of the group of nozzles.

The colored monofilaments spun from the spinning pack 1 are sequentially suspended and are received on the upper surface of the forming roll 19 and the reverse of the doormat and the middle layer thereof are formed by the accumulation of the random loops. And then, the part of the colored monofilaments is received on the water level 24 at a position lower than the upper surface of the forming roll 19, and the surface layer of the doormat is formed by the loops consisting of irregular three dimensional curve. Each of the loops is fused and bonded mutually at an intersecting portion where they are crossed mutually so that they are integrated. Thus, the mottled doormat is formed as the loops of the A color and the B color of the two colored monofilaments are mutually to be adjacent to each other in entangled form. Or the loops of the A colored and the B colored monofilaments are alternately accumulated in a fixed width, whereby the striped doormat is formed in which the A color and the B color are alternately disposed.

The doormat formed by the foregoing is carried to the outside of the cooling water tank 18 by the carrying belt 22 through the receiving roll 20 as shown by the arrow by the rotation of the forming roll 19, and then is carried by the carrying conveyor 23.

Accordingly, the molten resin extruded from the one extruder is A colored and the molten resin extruded from the other extruder is B colored, and they are supplied to the zone flowpath from the communicating pipe line, and the colored monofilaments are spun from the multi-hole nozzle holes. The spun colored monofilaments are accumulated in the random loop form on the collecting belt to form the doormat.

The branch flowpaths of each zone flowpath which are arranged obliquely in the advancing direction of the collecting belt, namely, the crosswise direction of the resin flowpath changeover unit are accumulated by drawing the loop so that the A colored and the B colored monofilaments are mutually to be adjacent to each other whereby the mottled different colors are formed. The branch flowpaths of each zone which are arranged in parallel to the crosswise direction of the resin flowpath changeover unit are such that the A colored and the B colored monofilaments are in the row form, namely, the coloration of the stripe. Therefore, in case the resin flowpath changeover unit whose forming direction of each flowpath is changed is exchanged, whereby the mottled multicolor doormat of the color pattern or the striped pattern multicolor doormat may be manufactured freely by changing over.

In the above-mentioned examples, in order to facilitate an easy comprehension of the description, an embodiment showed a multicolor doormat formed in two colored monofilaments consisting of an A color and a B color, and its manufacturing method and a doormat manufacturing device, but this invention can quote a multicolor doormat of more than three colors and a manufacturing method of such mats and a manufacturing device for such mats.

As described in the foregoing, this invention is to provide the multicolor doormat which has not been found heretofore, and is to provide a method of manufacturing by which it is effective and continuously manufactured, and to provide a doormat manufacturing device. Moreover, the mottled multicolor doormat or the striped multicolor doormat of different color can be easily manufactured by changing over the resin flowpath changeover unit of the spinning pack, and it has an epoch making effect.

What is claimed is:

1. A doormat manufacturing apparatus, comprising a spinning pack for spinning a large number of monofilaments, the spinning pack having a rectangular shape and defining a plane, a plurality of extruders disposed at opposite ends of the spinning pack for supplying a plurality of molten synthetic resins to the spinning pack, and a collecting mechanism for collecting monofilaments discharged from the spinning pack, the spinning pack comprising a resin flowpath changeover unit and a multihole nozzle plate, the resin flowpath changeover unit in contact with the multihole nozzle plate and having a longitudinal axis, the resin flowpath changeover unit having a respective communicating pipeline for each extruder, each communicating pipeline being connected to and longitudinally aligned with each respective extruder, the resin flowpath changeover unit having a plurality of longitudinally extending main flowpaths, each of which being longitudinally aligned with and communicating with a respective communicating pipeline, each longitudinally extending main flowpath having a plurality of branch flowpaths, each branch flowpath being angled with respect to said longitudinal axis, the pluralities of branch flowpaths substantially covering the surface of the resin flowpath changeover unit, and the multihole nozzle plate having at least one nozzle hole in communication with each branch flowpath of said plurality of branch flowpaths, the communicating pipelines, the longitudinally extending main flowpaths and the plurality of branch flowpaths lying in a plane of said resin flowpath changeover unit.

2. A doormat manufacturing apparatus as defined by claim 1, wherein each branch flowpath of said plurality of branch flowpaths extends obliquely with respect to the longitudinal axis of the resin flowpath changeover unit.

3. A doormat manufacturing apparatus as defined by claim 1, wherein each branch flowpath of said plurality of branch flowpaths divides into a plurality of subflowpaths.

4. A doormat manufacturing apparatus as defined by claim 1, wherein each extruder of said plurality of extruders contains a molten synthetic resin of a different color.

* * * * *